US008903283B2

(12) United States Patent
Hamada et al.

(10) Patent No.: US 8,903,283 B2
(45) Date of Patent: Dec. 2, 2014

(54) SHUTTER ASSEMBLY, POWDER CONTAINER, CLEANING DEVICE, AND IMAGE FORMING APPARATUS

(71) Applicants: Manabu Hamada, Osaka (JP); Masanari Fujita, Osaka (JP); Masato Tsuji, Osaka (JP); Yoshiyuki Shimizu, Osaka (JP); Tomohiro Kubota, Osaka (JP); Shoh Tsuritani, Osaka (JP)

(72) Inventors: Manabu Hamada, Osaka (JP); Masanari Fujita, Osaka (JP); Masato Tsuji, Osaka (JP); Yoshiyuki Shimizu, Osaka (JP); Tomohiro Kubota, Osaka (JP); Shoh Tsuritani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/944,359

(22) Filed: Jul. 17, 2013

(65) Prior Publication Data

US 2014/0050507 A1 Feb. 20, 2014

(30) Foreign Application Priority Data

Aug. 17, 2012 (JP) ..... 2012-180983

(51) Int. Cl.
*G03G 15/08* (2006.01)

(52) U.S. Cl.
CPC ..... *G03G 15/0865* (2013.01); *G03G 15/0886* (2013.01)
USPC ..... 399/260

(58) Field of Classification Search
CPC ..... G03G 15/0886
USPC ..... 399/260, 120, 360
See application file for complete search history.

(56) References Cited

U.S. PATENT DOCUMENTS

| | | | | |
|---|---|---|---|---|
| 8,744,321 | B2 * | 6/2014 | Kubota et al. | 399/263 |
| 8,792,808 | B2 * | 7/2014 | Kubota et al. | 399/119 |
| 2011/0076056 | A1 * | 3/2011 | Sato | 399/120 |
| 2013/0028638 | A1 | 1/2013 | Tsuritani et al. | |
| 2013/0142542 | A1 * | 6/2013 | Sato | 399/106 |

FOREIGN PATENT DOCUMENTS

| | | |
|---|---|---|
| JP | 2000-221766 | 8/2000 |
| JP | 2002-328513 | 11/2002 |
| JP | 2009-42567 | 2/2009 |
| JP | 2012-32460 | 2/2012 |

OTHER PUBLICATIONS

U.S. Appl. No. 13/908,434, filed Jun. 3, 2013.
U.S. Appl. No. 13/907,083, filed May 31, 2013.

* cited by examiner

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A shutter assembly includes an internal shutter and an external shutter. The internal shutter including a contact member is movable between a first position at which the internal shutter closes the outlet, a third position at which the internal shutter opens the outlet, and a second position between the first position and the third position. The internal shutter at the second position is movable to the third position while closing the outlet. The external shutter is movable between a closed position at which the external shutter closes the outlet and an open position at which the external shutter opens the outlet, and includes an interlocking member to contact the contact member to move the internal shutter. As the external shutter is moved from the closed position to the open position, the internal shutter is moved from the first position to the second position in conjunction with the external shutter.

15 Claims, 11 Drawing Sheets

SHUTTER ASSEMBLY, POWDER CONTAINER, CLEANING DEVICE, AND IMAGE FORMING APPARATUS

CROSS-REFERENCE TO RELATED APPLICATIONS

This patent application is based on and claims priority pursuant to 35 U.S.C. §119 to Japanese Patent Application No. 2012-180983, filed on Aug. 17, 2012, in the Japan Patent Office, the entire disclosure of which is hereby incorporated by reference herein.

BACKGROUND

1. Technical Field

Exemplary aspects of the present disclosure generally relate to a shutter assembly for opening and closing an outlet of a powder container from which powder is discharged.

2. Description of the Related Art

In known electrophotographic image forming apparatuses, a toner cartridge storing toner and a process unit including image forming components such as a photosensitive drum and a developing roller are constituted as separate units to facilitate replacement and maintenance. Generally, the toner cartridge includes an outlet from which toner inside thereof is discharged when supplying toner. The outlet is formed detachably attachable relative to an inlet provided to the process unit. When removing the toner cartridge from the process unit, the toner is spilled from the outlet of the toner cartridge. In view of this, a known toner cartridge is provided with a shutter to prevent the toner from leaking from the outlet. Furthermore, to prevent toner leakage more reliably, in one approach, two shutters are provided.

Although advantageous, when employing two shutters such as an internal shutter and an external shutter that open and close independently, only the internal shutter may accidentally open upon replacement of the toner cartridge. If the internal shutter is opened while the external shutter is closed, the toner leaked from the outlet accumulates between the internal shutter and the external shutter. When the external shutter opens in this state, the accumulated toner between these shutters is spilled out, causing contamination of the toner cartridge and hands of users and technicians, hence complicating replacement of the toner cartridge. Such spilled toner may also stick to devices in the image forming apparatus, causing errors during operation.

SUMMARY

In view of the above, there is an unsolved need for a shutter assembly that prevents an internal shutter from opening while an external shutter is closed. In an aspect of this disclosure, there is provided an improved a shutter assembly for opening and closing an outlet of a powder container from which powder is discharged. The shutter assembly includes an internal shutter and an external shutter. The internal shutter is movable between a first position at which the internal shutter closes the outlet, a third position at which the internal shutter opens the outlet, and a second position between the first position and the third position, at which the internal shutter is movable to the third position while closing the outlet. The internal shutter includes a contact member. The external shutter is movable between a closed position at which the external shutter closes the outlet and an open position at which the external shutter opens the outlet, and includes an interlocking member to contact the contact member of the internal shutter to move the internal shutter. As the external shutter is moved from the closed position to the open position, the internal shutter is moved from the first position to the second position in conjunction with movement of the external shutter.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
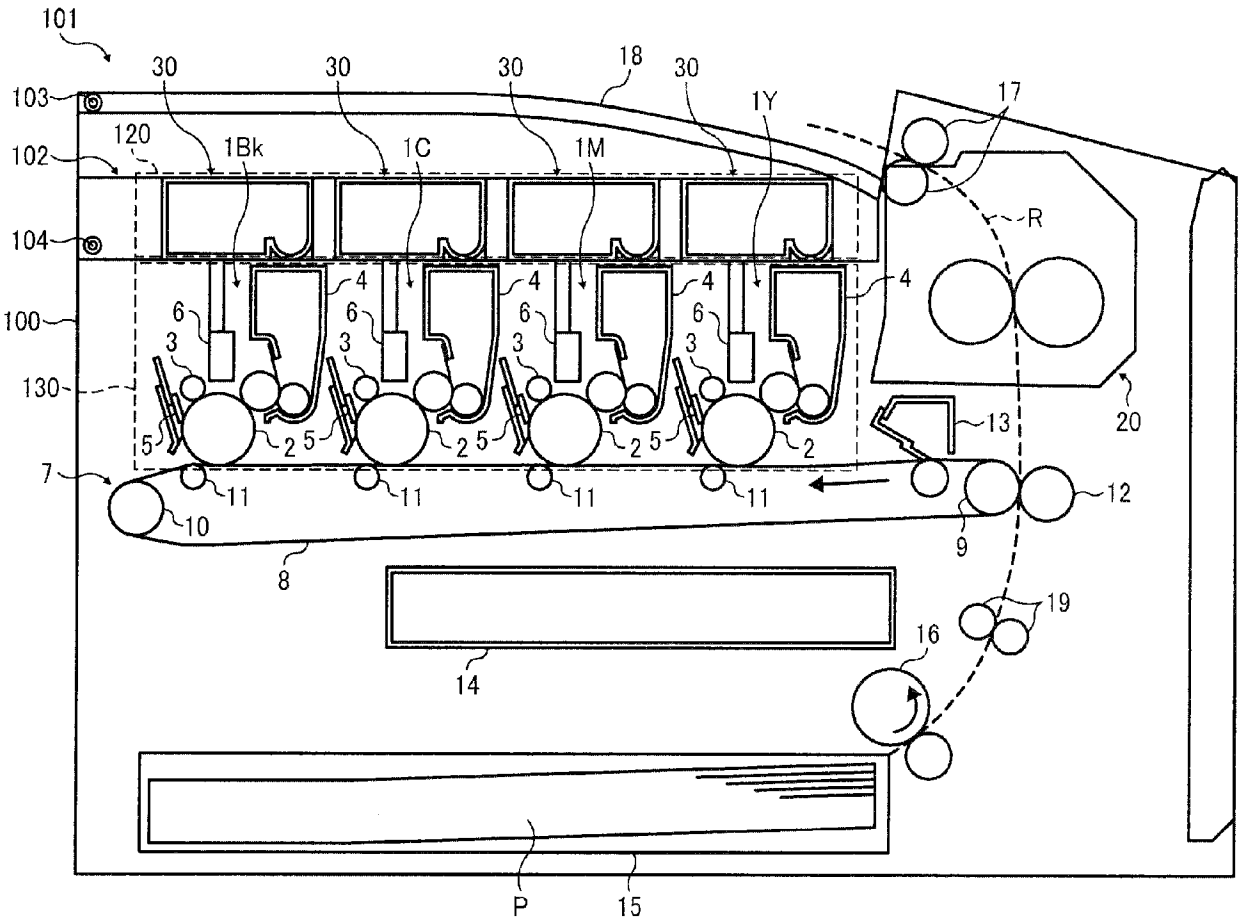
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of a color laser printer as an example of an image forming apparatus according to an illustrative embodiment of the present disclosure. The image forming apparatus includes, but is not limited to, a color laser printer, a printer, a copier, a facsimile machine, and a multifunction machine including at least two of these functions.

As illustrated in FIG. 1, an image forming apparatus 100 includes four process units 1Y, 1M, 1C, and 1BK serving as image forming units detachably attachable relative to the body of the image forming apparatus 100. The process units 1Y, 1M, 1C, and 1BK all have the same configuration as all the others, differing only in the color of toner employed. That is, the process units 1Y, 1M, 1C, and 1BK store toner of yellow, magenta, cyan, and black, each corresponding to the color separation component of a color image, respectively. It is to be noted that the suffixes Y, M, C, and BK denote colors yellow, magenta, cyan, and black, respectively. To simplify the description, these suffixes Y, M, C, and BK indicating colors are omitted herein, unless otherwise specified.

More specifically, each of the process units 1Y, 1M, 1C, and 1BK includes a photosensitive drum 2, a charging roller 3, a developing device 4, a cleaning blade 5, and so forth. The photosensitive drum 2 serves as a latent image bearing member. The charging roller 3 serves as a charging device to charge the surface of the photosensitive drum 2. The developing device 4 develops a latent image formed on the photosensitive drum 2 into a visible image known as a toner image. The cleaning blade 5 serves as a cleaning device that cleans the surface of the photosensitive drum 2. An exposure device 6 serving as a latent image forming device is disposed opposite each of the photosensitive drums 2. The exposure device 6 forms a latent image on the surface of the photosensitive drum 2. According to the present illustrative embodiment, an LED unit is employed as the exposure device 6.

Toner cartridges 30 are detachably disposed above the respective developing devices 4. The toner cartridges 30 store powder toners used for image formation. The toner cartridges 30 store toners of respective colors corresponding to the colors of toners in the developing devices 4. When the amount of toner in the developing device 4 drops below a predetermined amount, the toner cartridge 30 supplies toner to the developing device 4. It is to be noted that, although the image forming apparatus of the present illustrative embodiment employs a single-component developing agent including only toner particles, a two-component developing agent including toner particles and carrier particles may be employed.

A transfer device 7 is disposed substantially below the photosensitive drums 2. The transfer device 7 includes a belt-type intermediate transfer member (hereinafter referred to as intermediate transfer belt) 8 serving as a latent image bearing member. The intermediate transfer belt 8 is formed into an endless loop and entrained around a plurality of support rollers. More specifically, the intermediate transfer belt 8 is entrained around a drive roller 9 and a driven roller 10. As the drive roller 9 rotates in the counterclockwise direction in FIG. 1, the intermediate transfer belt 8 is rotated in the direction indicated by an arrow in FIG. 1.

Primary transfer rollers 11 are disposed inside the looped intermediate transfer belt 8, opposite each of the photosensitive drums 2. The primary transfer rollers 11 press the inner surface of the intermediate transfer belt 8, opposite each of the photosensitive drums 2 so that the intermediate transfer belt 8 contacts the photosensitive drums 2, thereby forming primary transfer nips therebetween. The primary transfer rollers 11 are connected to a power source and supplied with a certain direct current (DC) voltage and/or an alternating current (AC) voltage.

A secondary transfer roller 12 serving as a secondary transfer mechanism is disposed outside the loop formed by the intermediate transfer belt 8, opposite the drive roller 9. The secondary transfer roller 12 presses the outer circumferential surface of the intermediate transfer belt 8, thereby forming a secondary transfer nip therebetween. Similar to the primary transfer rollers 11, the secondary transfer roller 12 is connected to a power source and supplied with a certain DC voltage and/or an AC voltage.

A belt cleaning device 13 is disposed substantially at the right end of the looped intermediate transfer belt 8, to clean the surface of the intermediate transfer belt 8. Although not illustrated, a waste toner conveyance tube extends from the belt cleaning device 13 and connects to an opening of a waste toner container 14 disposed below the transfer device 7.

A sheet tray 15 storing a stack of recording media P, a sheet feed roller 16, and so forth are disposed at the bottom of the image forming apparatus 100. A recording medium P includes, but is not limited to, thick paper, postcards, envelopes, normal paper, thin paper, coated paper such as coated paper and art paper, tracing paper, an OHP sheet, and an OHP film.

A pair of sheet output rollers 17 and a sheet output tray 18 are disposed at the upper portion of the image forming apparatus 100. The pair of sheet output rollers 17 outputs the recording medium P outside the image forming apparatus 100 onto the sheet output tray 18.

In the image forming apparatus 100, a sheet path R, along which the recording medium P is delivered from the sheet tray 15 to the sheet output tray 18 via the secondary transfer nip, is formed. A pair of registration rollers 19 is disposed in the sheet conveyance path R upstream from the secondary transfer roller 12 in the direction of conveyance of the recording medium P. The pair of registration rollers 19 serves as timing rollers that measure a timing at which the recording medium P is fed to the secondary transfer nip. A fixing device 20 for fixing an unfixed toner image on the recording medium P is disposed downstream from the secondary transfer roller 12 in the direction of conveyance of the recording medium P.

Still with reference to FIG. 1, a description is provided of operation of the image forming apparatus 100 according to an illustrative embodiment of the present invention.

As the image forming operation is initialized, the photosensitive drums 2 of the process units 1Y, 1M, 1C, and 1BK are rotated in the clockwise direction in FIG. 1, and the charging rollers 3 charge the surfaces of the photosensitive drums 2. Accordingly, the surfaces of the photosensitive drums 2 are charged uniformly to a certain polarity by the charging rollers 3. Subsequently, based on image information of a document read by an image reading device, the charged surfaces of the photosensitive drums 2 are illuminated with laser light projected from the exposure device 6. Accordingly, electrostatic latent images are formed on the surfaces of the photosensitive drums 2. More specifically, upon exposure of the photosensitive drums 2, the image information of the document is separated into a single color component of yellow, magenta, cyan, and black, and the photosensitive drums 2 are illuminated with laser light corresponding to the single color information thus obtained.

The electrostatic latent images formed on the photosensitive drums 2 are developed with toner supplied from the developing devices 4 into visible images, known as toner images.

After the image forming operation is started, the drive roller 9, around which the intermediate transfer belt 8 is entrained, starts to rotate in the direction of arrow in FIG. 1, enabling the intermediate transfer belt 8 to move in the direction of arrow in FIG. 1. The primary transfer rollers 11 are supplied with a constant voltage having a polarity opposite that of the charge polarity of toner or a voltage under constant current control, thereby forming a transfer electric field in primary transfer nips between each of the primary transfer rollers and the photosensitive drums 2.

Subsequently, in conjunction with rotation of the photosensitive drums 2, the toner images on the photosensitive drums 2 arrive at the primary transfer nips in which the toner images on the photosensitive drums 2 are transferred onto the intermediate transfer belt 8 such that they are superimposed one atop the other. Accordingly, a composite toner image is formed. Residual toner, not having been transferred and thus remaining on the photosensitive drums 2 is removed by the cleaning blades 5.

At the bottom of the image forming apparatus 100, as the sheet feed roller 16 rotates, picking up the top sheet of the recording media P in the sheet tray 15 and feeds it to the sheet path R. Conveyance of the recording medium P fed to the sheet path R is temporarily stopped by the pair of the registration rollers 19.

Subsequently, the pair of the registration rollers 19 is rotated again to feed the recording medium P to the secondary transfer nip in appropriate timing such that the recording medium P is aligned with the composite toner image formed on the intermediate transfer belt 8 arriving at the secondary transfer nip. At this time, the secondary transfer roller 12 is supplied with a transfer voltage having a polarity opposite the charge polarity of toner of the toner image on the intermediate transfer belt 8, thereby forming a transfer electric field at the secondary transfer nip. Due to the transfer electric field, the toner image on the intermediate transfer belt 8 is transferred onto the recording medium P.

Residual toner, not having been transferred, thus remaining on the intermediate transfer belt 8 is removed by the belt cleaning device 13. The removed toner is sent to the waste toner container 14.

After the composite toner image is transferred onto the recording medium P, the recording medium P is delivered to the fixing device 20 in which heat and pressure are applied to the recording medium P, thereby fixing the composite toner image on the recording medium P. After the toner image is fixed on the recording medium P, the recording medium P is discharged and stacked onto the sheet output tray 18 by the pair of sheet output rollers 17.

The above description pertains to the image forming operation for forming a multiple-color image on a recording medium. However, the image forming operation is not limited thereto. The image forming apparatus 100 may form a single-color image using one of process units 1Y, 1M, 1C, and 1BK, or an image consisting of at least two colors using at least two process units.

Figure 2:
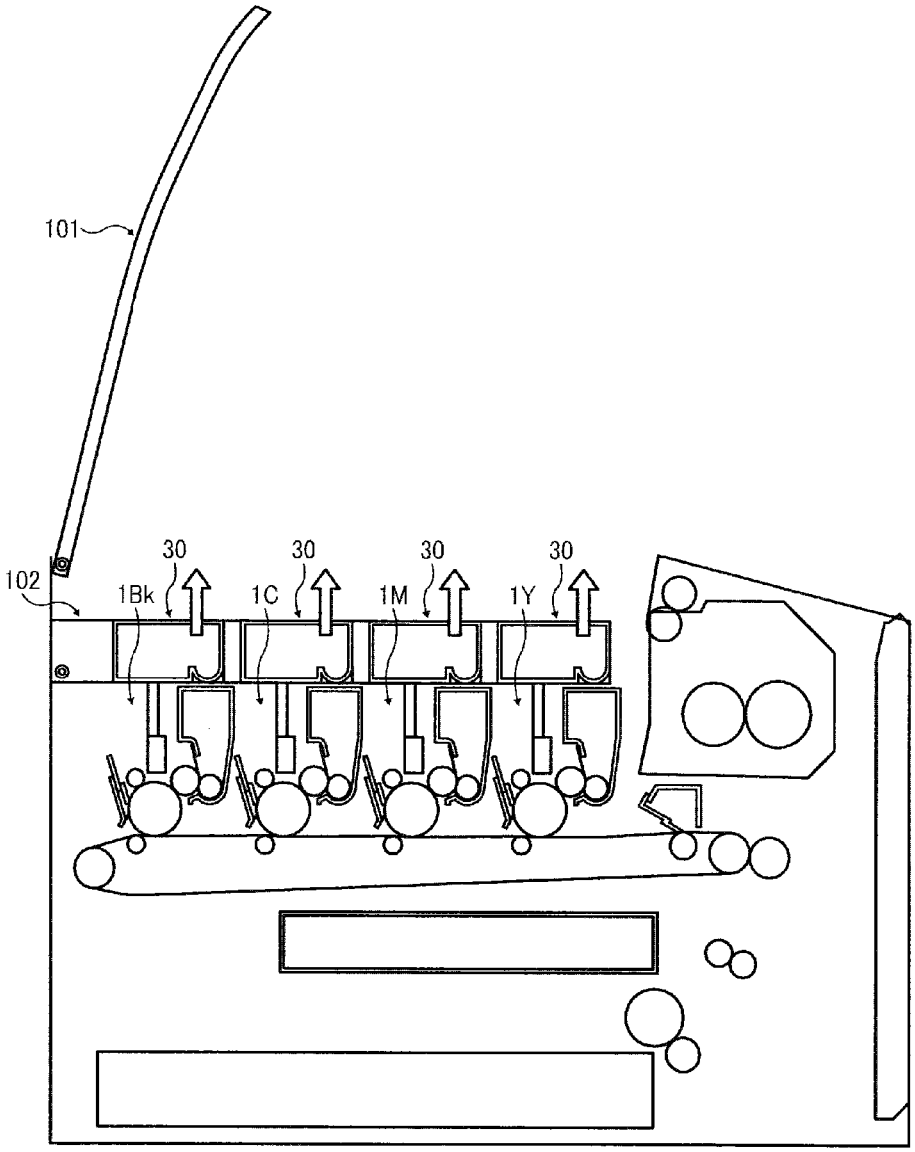
FIG. 2 is a schematic diagram illustrating the image forming apparatus of FIG. 1 with a top cover thereof being opened.
Figure 3:
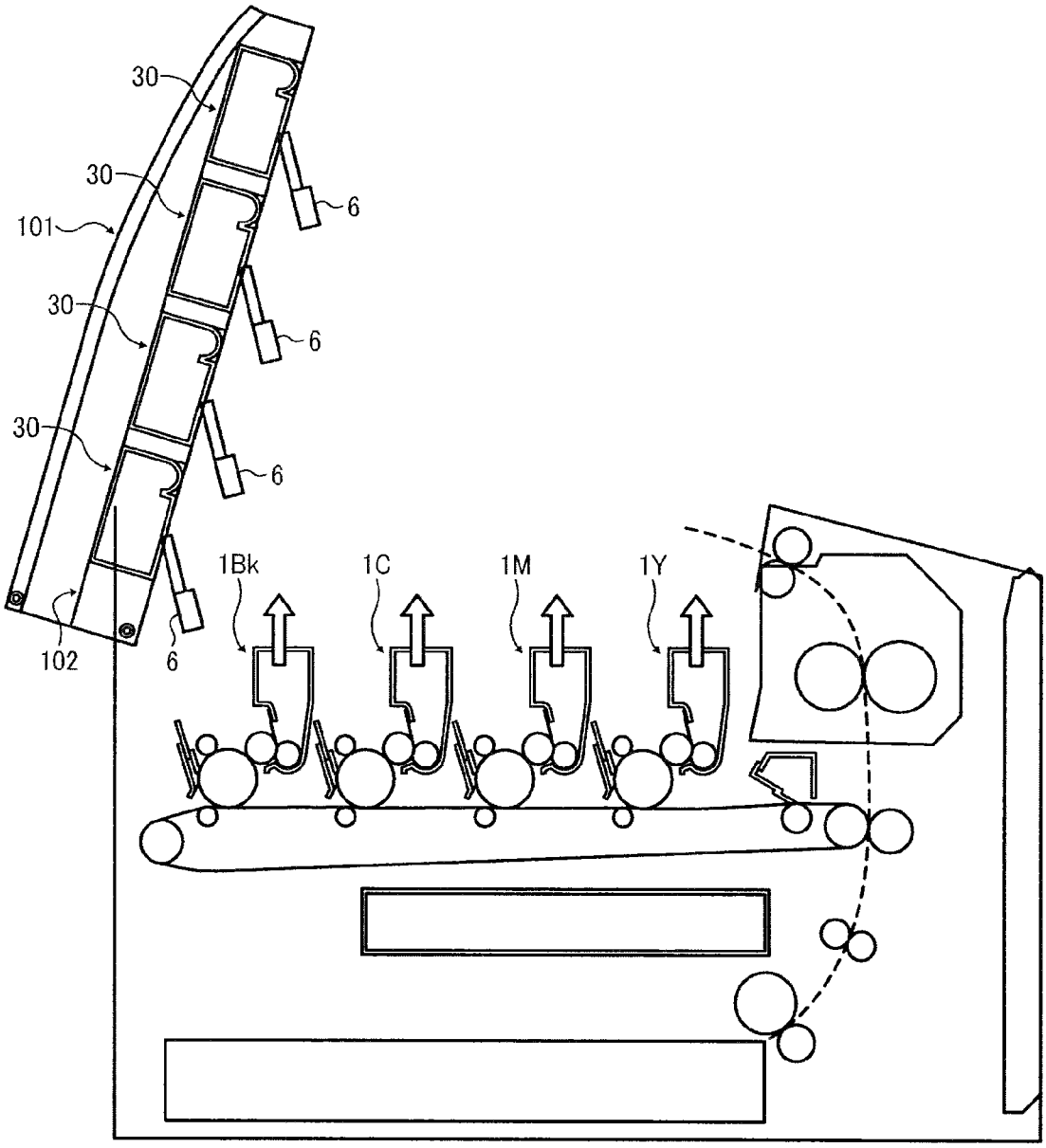
FIG. 3 is a schematic diagram illustrating the image forming apparatus in a state in which the top cover and a middle cover are opened.

According to the illustrative embodiment, the image forming apparatus 100 includes a top cover 101 serving as a first cover and a middle cover 102 serving as a second cover. The top cover 101 is disposed at the upper portion of the image forming apparatus 100. The middle cover 102 is disposed substantially below or interior to the top cover 101. The top cover 101 is rotatable about a shaft 103 and openably closable relative to the image forming apparatus 100. The middle cover 102 is rotatable about a shaft 104 and openably closable relative to the image forming apparatus 100. FIG. 2 shows the image forming apparatus 100 with the top cover 101 opened. FIG. 3 shows the image forming apparatus 100 with both the top cover 101 and the middle cover 102 opened.

The middle cover 102 includes a toner cartridge mounting portion 120 (shown in FIG. 1) that accommodates the plurality of toner cartridges 30. The image forming apparatus 100 includes a process unit mounting portion 130 that accommodates the process units 1Y, 1M, 1C, and 1BK. The process unit mounting portion 130 is disposed interior to or below the middle cover 102.

Opening the top cover 101 as illustrated in FIG. 2 allows the toner cartridges 30 to be detached from and attached to the middle cover 102 from the upper portion thereof.

Furthermore, as illustrated in FIG. 3, with the middle cover 102 opened, the toner cartridges 30 can be retracted together from the upper portion of the process units 1Y, 1M, 1C, and 1BK. In the meantime, the exposure devices 6 retract from the photosensitive drums 2 together with the middle cover 102, thereby allowing the process units 1Y, 1M, 1C, and 1BK to be detached from and attached to the image forming apparatus 100 from the upper portion. According to the present illustrative embodiment, the process units 1Y, 1M, 1C, and 1BK can be detached and attached without removing the toner cartridges 30 from the middle cover 102, thereby facilitating replacement of the process units 1Y, 1M, 1C, and 1BK.

Figure 4:
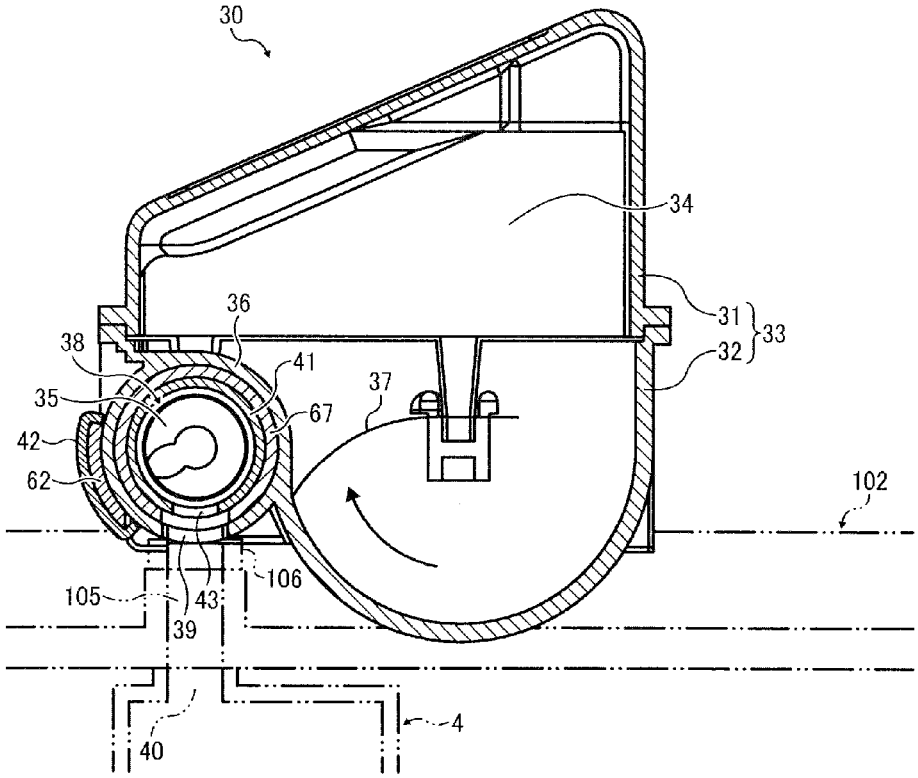
FIG. 4 is a cross-sectional view schematically illustrating a toner cartridge employed in the image forming apparatus.
Figure 5:
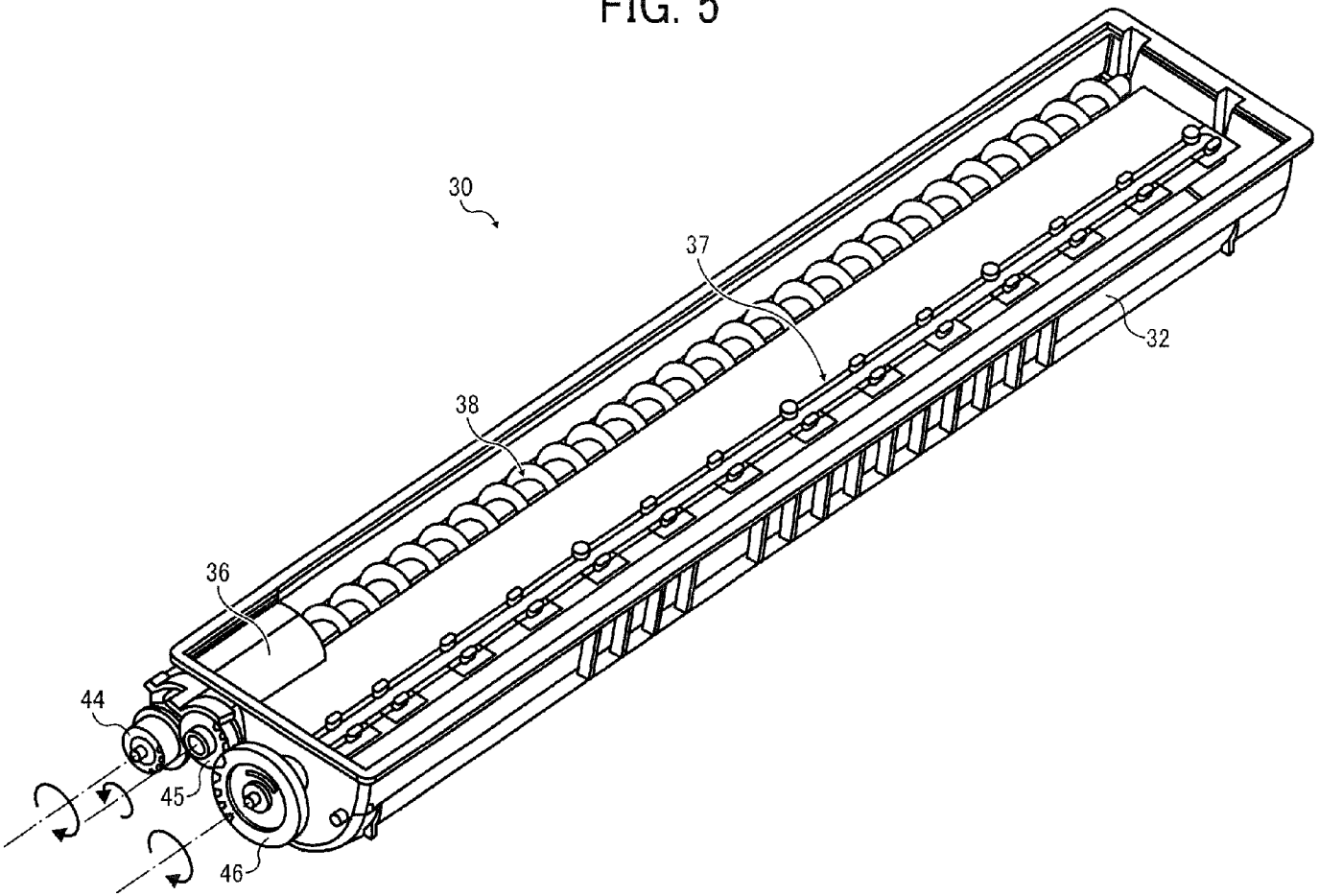
FIG. 5 is a perspective view schematically illustrating the toner cartridge in a state in which an upper casing is removed from the toner cartridge.

With reference to FIGS. 4 and 5, a description is provided of the toner cartridges 30. FIG. 4 is a cross-sectional diagram schematically illustrating the toner cartridge 30. FIG. 5 is a perspective view schematically illustrating the external configuration of the toner cartridge 30. It is to be noted that the toner cartridges 30 all have the same configuration as all the others, differing only in the color of toner employed. Thus, a description is provided of one of the toner cartridges 30.

As illustrated in FIG. 4, the toner cartridge 30 includes a container 33 consisting of an upper casing 31 and a lower casing 32 adhered to the upper casing 31. The upper casing 31 and the lower casing 32 are adhered together through welding process such as vibration welding and ultrasonic welding. Alternatively, the upper casing 31 and the lower casing 32 are adhered together using double-sided tape or an adhesive agent.

The container 33 includes a powder storage compartment 34 storing toner to be supplied and a powder transport portion 35 inside the container 33. The powder storage compartment 34 and the powder transport portion 35 are separated by a semicylinder-shaped separator 36. The powder storage compartment 34 includes an agitator 37 to mix the toner. The powder transport portion 35 includes a conveyor screw 38 to transport the toner.

The container 33 includes an outlet 39 which is an opening from which toner transported by the conveyor screw 38 is discharged. The outlet 39 is connected to a connecting opening 105 formed in the middle cover 102 via a sealing member 106. The connecting opening 105 is connected to an inlet 40 which is an opening formed at the upper portion of the developing device 4. In other words, as the toner cartridge 30 is mounted on the middle cover 102, the outlet 39 and the inlet 40 are connected via the connecting opening 105, and the toner can be supplied from the toner cartridge 30 to the developing device 4.

The toner cartridge 30 includes a shutter assembly to open and close the outlet 39. More specifically, the shutter assembly has two shutters including an internal shutter 41 and an external shutter 42. The internal shutter 41 is disposed inside the outlet 39. The external shutter 42 is disposed outside the outlet 39.

The internal shutter 41 is a cylindrical-shaped rotary shutter disposed inside the powder transport portion 35. The internal shutter 41 includes an opening 43 formed in the circumference thereof. The internal shutter 41 is movable between a first position (closed position) at which the internal shutter 41 closes the outlet 39, a third position (open position) at which the internal shutter 41 opens the outlet 39, and a second position (operable position) between the first position and the third position. The internal shutter 41 at the second position is in a state in which the internal shutter 41 is movable to the third position while closing the outlet 39. Rotation of the internal shutter 41 about its axis changes the position of the opening 43 between an open position at which the opening 43 faces the outlet 39 and a closed position at which the opening 43 is retracted from the opening position.

The center of rotation of the external shutter 42 coincides with the center of rotation of the internal shutter 41. That is, the external shutter 42 is concentric with the internal shutter 41. As the external shutter 42 is rotated, the outlet 39 is opened and closed.

As illustrated in FIG. 5, an outer side surface of the lower casing 32 includes a gear train consisting of a plurality of gears 44, 45, and 46 to transmit a drive force to the conveyor screw 38 and the agitator 37. A drive gear 44 attached to one end of a rotary shaft of the conveyor screw 38 serves as a drive gear for transport of the toner. A drive gear 46 attached to one end of a rotary shaft of the agitator 37 serves as a drive gear for mixing the toner. A torque-transmission gear 45 transmits a rotational torque by meshing with the gear 44 and the gear 46.

When the toner cartridge 30 is installed in the image forming apparatus 100, the drive gear 44 meshes with a drive gear of the body of the image forming apparatus 100. In a state in which the drive gear 44 meshes with the drive gear of the image forming apparatus 100, the drive gear 44, the torque-transmission gear 45, and the drive gear 46 rotate in directions indicated by arrows in FIG. 5, causing the conveyor screw 38 and the agitator 37 to rotate. It is to be noted that the gear meshing with the drive gear of the image forming apparatus 100 is not limited to the drive gear 44. The torque-transmission gear 45 or the drive gear 46 may mesh with the drive gear of the image forming apparatus 100.

Figure 6:
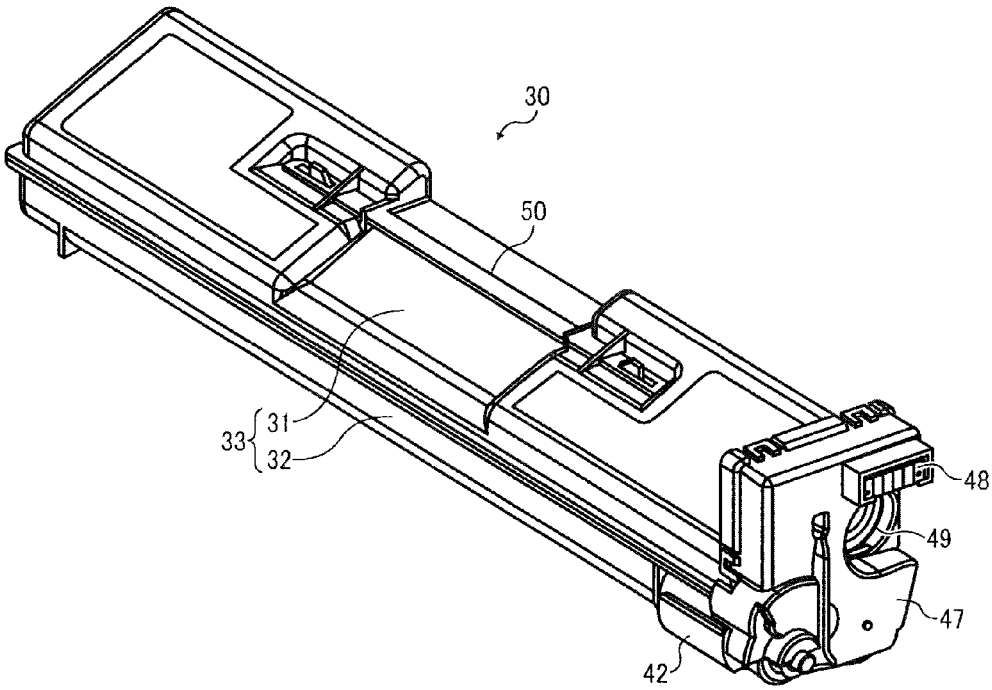
FIG. 6 is a perspective view schematically illustrating an exterior of the toner cartridge.

As illustrated in FIG. 6, a cover 47 is disposed at the lateral side of the container 33 in the longitudinal direction thereof to cover the gears 44, 45, and 46. The cover 47 includes an information storage device 48 that stores information on the toner cartridges 30 such as the colors and the amount of stored toner. The information storage device 48 includes a plurality of connector terminals. By electrically connecting the connector terminals to an information reading device of the image forming apparatus 100, the information on the toner cartridge 30 is read or information stored in the information storage device 48 is updated.

As illustrated in FIG. 6, the end portion of the container 33 provided with the cover 47 includes a cap 49 to seal the opening from which toner is supplied to the toner cartridge 30. After the toner cartridge 30 is filled with the toner from the opening, the opening is sealed with the cap 49, thereby preventing leakage of the toner from the opening.

As illustrated in FIG. 6, a handle 50 is provided at a substantially center of the upper surface of the container 33 in the longitudinal direction. The handle 50 is formed of flexible material such as polypropylene and polypropylene. Upon replacement of the toner cartridge 30, technicians or users may hold the handle 50 so that the toner cartridge 30 is detached and attached easily.

Figure 7:
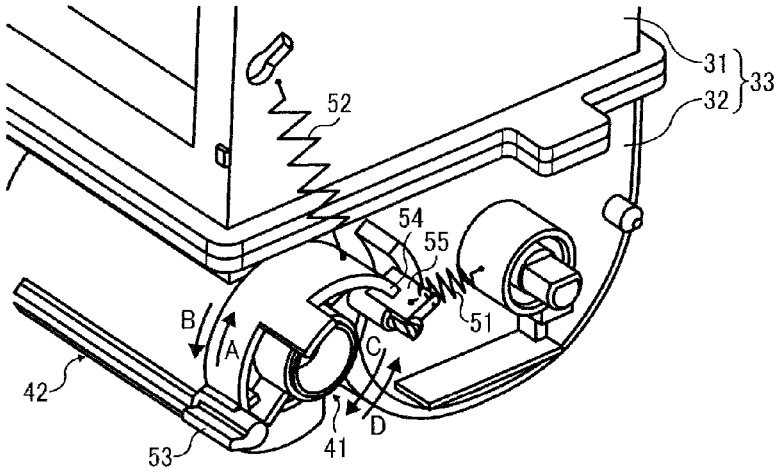
FIG. 7 is a partially enlarged schematic diagram illustrating a shutter assembly according to an illustrative embodiment of the present disclosure.

With reference to FIG. 7, a description is provided of the shutter assembly according to an illustrative embodiment. FIG. 7 is a partially enlarged schematic diagram illustrating the shutter assembly.

As illustrated in FIG. 7, the external shutter 42 is rotatable in directions indicated by arrows A and B. A tension spring 52 serving as a biasing mechanism for biasing the external shutter 42 is attached to the external shutter 42. Tension of the tension spring 52 biases the external shutter 42 in the direction of arrow B. The external shutter 42 includes a tab 53 serving as an operating member by which the external shutter 42 is rotated in the direction of arrow A. Furthermore, the external shutter 42 includes an interlocking member 54 that contacts the internal shutter 41 when the external shutter 42 rotates in the direction of arrow A, thereby moving the internal shutter 41 in conjunction with the external shutter 42.

As illustrated in FIG. 7, the internal shutter 41 is rotatable in directions indicated by arrows C and D. A tension spring 51 serving as a biasing member for biasing the internal shutter 41 is attached to the internal shutter 41. The tension spring 51 biases the internal shutter 41 in the direction of arrow D. The internal shutter 41 includes a contact member 55 that contacts the interlocking member 54 of the external shutter 42. According to the present illustrative embodiment, in the state shown in FIG. 7 the interlocking member 54 contacts the contact member 55. Alternatively, the interlocking member 54 may be separated from the contact member 55 in the state shown in FIG. 7.

Figure 8:
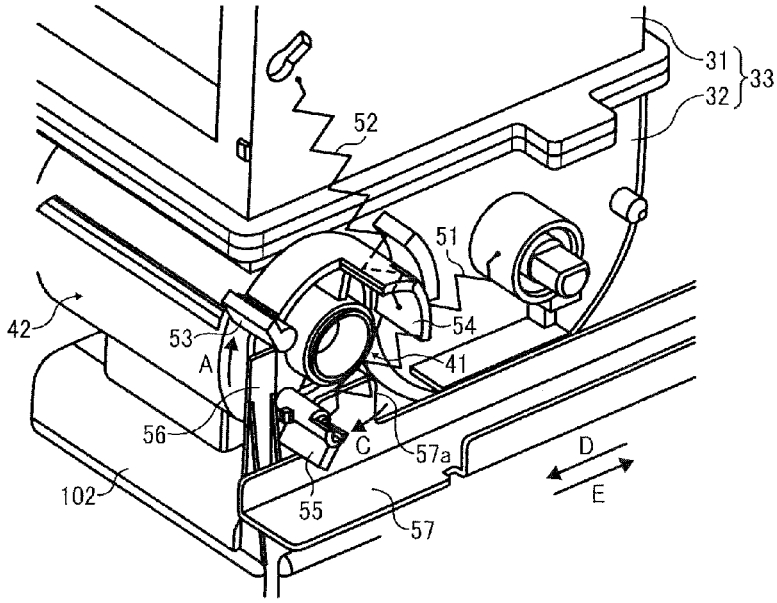
FIG. 8 is a partially enlarged schematic diagram illustrating a rotation mechanism that rotates an external shutter and an internal shutter.

FIG. 8 illustrates a configuration for rotating the external shutter 42 and the internal shutter 41. According to the present illustrative embodiment, as illustrated in FIG. 8, the image forming apparatus 100 includes a rib 56 serving as an external-shutter moving device to rotate the external shutter 42. More specifically, the rib 56 projects from the middle cover 102 upward (in the direction opposite the direction of installation of the toner cartridge 30). Upon installation of the toner cartridge 30, the rib 56 comes into contact with the tab 53 of the external shutter 42, thereby rotating the external shutter 42 in the direction indicated by an arrow A.

As illustrated in FIG. 8, the image forming apparatus 100 includes an internal-shutter moving device 57 serving as a moving device to rotate the internal shutter 41. The internal-shutter moving device 57 is long in a direction indicated by an arrow E and movable in directions of arrows D and E. According to the present illustrative embodiment, as the top cover 101 is closed and the power of the image forming apparatus 100 is turned on, the internal-shutter moving device 57 is moved in the direction of arrow D by a driving device such a solenoid and a cam.

As the internal-shutter moving device 57 moves in the direction of arrow D and a tab 57*a* of the internal-shutter moving device 57 contacts the contact member 55 of the internal shutter 41, the internal shutter 41 is rotated in the direction of arrow C. According to the present illustrative embodiment, the contact member 55 of the internal shutter 41 serves also as an operating member to rotate the internal shutter 41 as the moving member 57 contacts the contact member 55.

Figure 9:
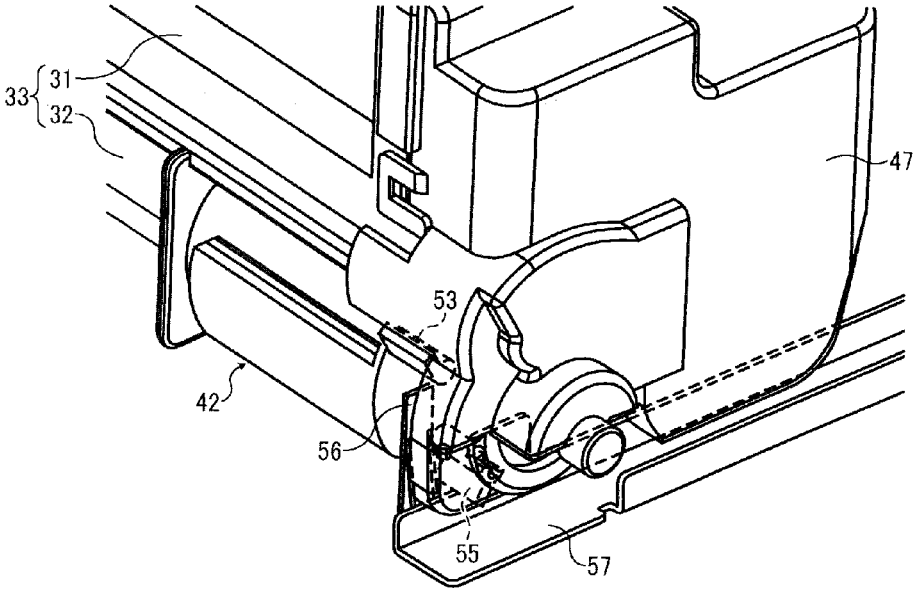
FIG. 9 is a schematic diagram illustrating the toner cartridge including a cover attached to a lateral surface of the toner cartridge.

FIG. 9 illustrates the toner cartridge 30 with the cover 47 attached to the side of the toner cartridge 30. As illustrated in FIG. 9, while the cover 47 is attached to the side of the container 33 of the toner cartridge 30, the tab 53 of the external shutter 42 and the contact member 55 of the internal shutter 41 are covered with the cover 47. In order to contact the tab 53 or the contact member 55, the rib 56 and the moving member 57 both serving as operating members can enter inside the cover 47.

Figure 10:
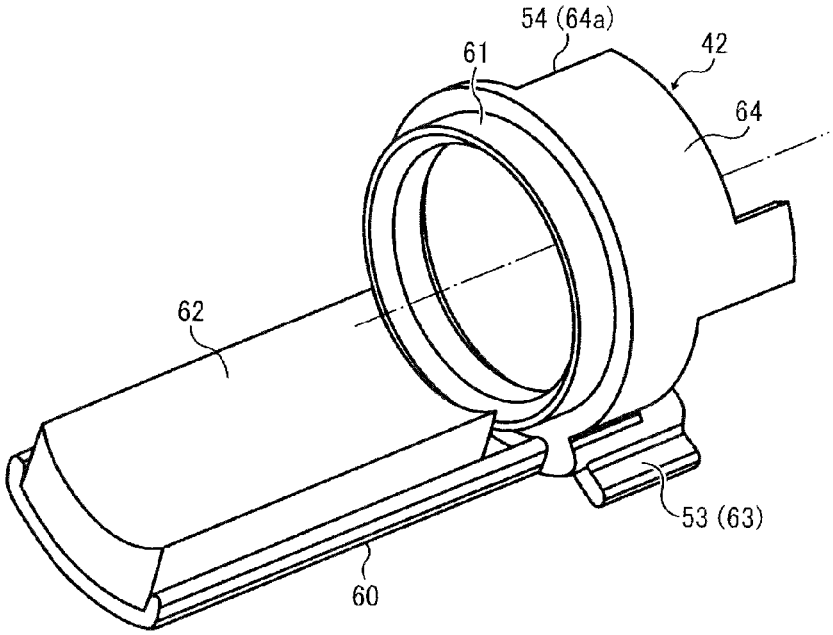
FIG. 10 is an external perspective view schematically illustrating the external shutter.
Figure 11:
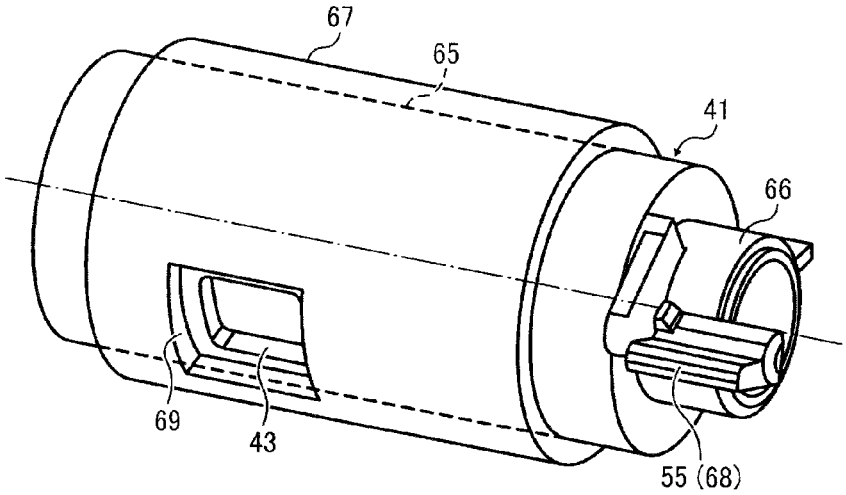
FIG. 11 is a perspective view schematically illustrating the internal shutter.

With reference to FIGS. 10 and 11, a description is provided of the external shutter 42 and the internal shutter 41. FIG. 10 is an external perspective view schematically illustrating the external shutter 42. FIG. 11 is an external view schematically illustrating the internal shutter 41. As illustrated in FIG. 10, the external shutter 42 includes a cover 60 and a retainer 61 having an annular shape. The cover 60 is formed in the shape of arc of a circle. The retainer 61 is disposed at one end of the cover 60. The cover 60 and the retainer 61 are constituted as a single integrated unit.

A sealing member 62 is disposed on the inner surface of the cover 60 to prevent toner from leaking from the outlet 39 (shown in FIG. 4). More specifically, the sealing member 62 is disposed between the inner surface of the cover 60 and the outer surface of the container 33 of the toner cartridge 30 (shown in FIG. 4). With this configuration, when the external shutter 42 is closed, the outlet 39 is sealed by the sealing member 62.

The retainer 61 is fitted to the outer circumferential surface of the internal shutter 41, thereby holding rotatably the external shutter 42 in the circumferential direction relative to the internal shutter 41. The retainer 61 includes the tab 53 and the interlocking member 54. According to the present illustrative embodiment, the tab 53 includes a projection 63 projecting in the radial direction of the retainer 61. As illustrated in FIG. 4, the interlocking member 54 is constituted of an end surface 64*a* of an arc-shaped piece 64 extending in the axial direction of the retainer 61.

As illustrated in FIG. 11, the internal shutter 41 includes a cylindrical-shaped cover 65 to be accommodated in the container 33 of the toner cartridge 30 and a projecting portion 66 disposed integrally with one end of the cover 65 in the axial direction thereof projecting beyond the container 33.

The cover 65 includes the opening 43 that can come to a position opposite the outlet 39. A sealing member 67 is disposed on the outer surface of the cover 65 to prevent toner from leaking from the outlet 39. More specifically, the sealing member 67 is disposed between the outer surface of the cover 65 and the inner surface of the container 33 of the toner cartridge 30 (shown in FIG. 4). With this configuration, when the internal shutter 41 is closed, the outlet 39 is sealed by the sealing member 67. The sealing member 67 includes an opening 69 formed at a position opposite the opening 43 of the internal shutter 41.

The projecting portion 66 includes the contact member 55 serving as an operating member. According to the present illustrative embodiment, the operating member 55 includes a projection 68 projecting in the radial direction of the projecting portion 66. The retainer 61 of the external shutter 42 is fitted to the outer circumferential surface of the projecting portion 66.

Figure 12A:
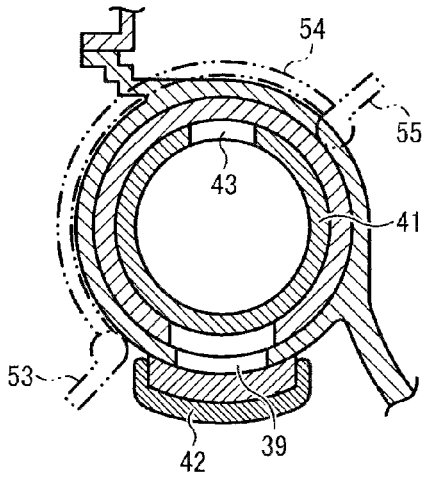
FIG. 12A is a cross-sectional diagram schematically illustrating the internal shutter and the external shutter when the internal shutter is at a first position (closed position) before the toner cartridge is installed in the image forming apparatus.
Figure 12B:
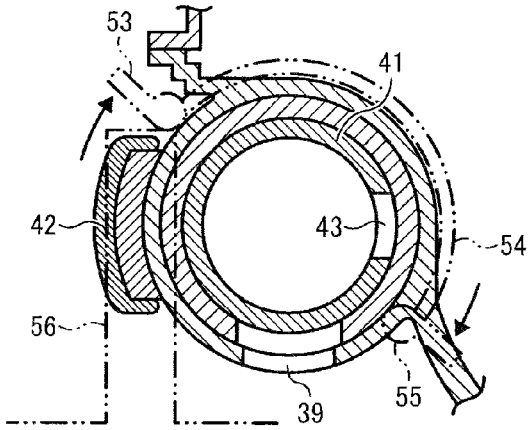
FIG. 12B is a cross-sectional diagram schematically illustrating the internal shutter and the external shutter when the toner cartridge is installed in the image forming apparatus and the internal shutter is at a second position.
Figure 12C:
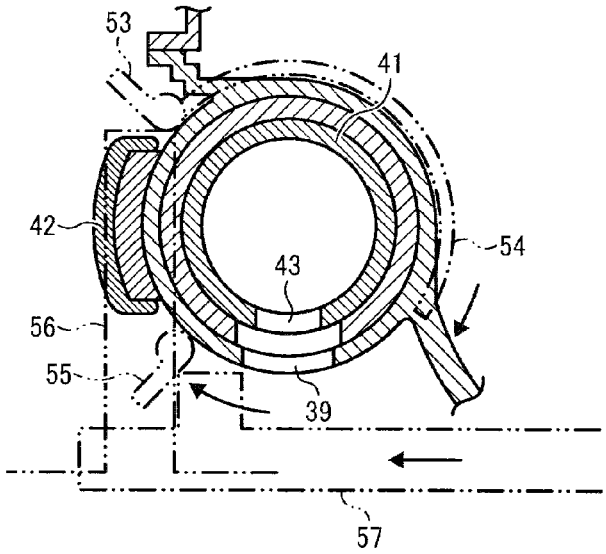
FIG. 12C is a cross-sectional diagram schematically illustrating the internal shutter at a third position (open position) when an internal-shutter moving device contacts the internal shutter to open an outlet.

With reference to FIGS. 12A through 12C, a description is provided of movement of the external shutter 42 and the internal shutter 41.

FIG. 12A is a partially enlarged cross-sectional view schematically illustrating the external shutter 42 and the internal shutter 41 before the toner cartridge 30 is installed in the image forming apparatus 100. In this state, the external shutter 42 and the internal shutter 41 are pulled by the tension springs 51 and 52, respectively, as shown in FIG. 7, thereby closing the outlet 39.

As the toner cartridge 30 is installed in the image forming apparatus 100, as illustrated in FIG. 12B, the rib 56 at the image forming apparatus main body side contacts the tab 53 of the external shutter 42, thereby rotating the external shutter 42 in the clockwise direction against the biasing force of the tension spring 52. Accordingly, the external shutter 42 moves to the open position, thereby opening the outlet 39.

At this time, in conjunction with the rotation of the external shutter 42, the interlocking member 54 of the external shutter 42 presses the contact member 55 of the internal shutter 41, thereby rotating the internal shutter 41 in the same direction as the external shutter 42. With this configuration, the internal shutter 41 is moved to the second position at which the internal shutter 41 is enabled to move to the third position (shown in FIG. 12C) to open the outlet 39 while closing the outlet 39. More specifically, in a state in which the internal shutter 41 is at the second position as shown in FIG. 12B, the opening 43 of the internal shutter 41 has not come to a position facing the outlet 39. Thus, the outlet 39 remains closed by the internal shutter 41.

After the toner cartridge 30 is installed in the image forming apparatus 100 and the top cover 101 is closed, when the image forming apparatus 100 is turned on the internal-shutter moving device 57 is driven by a driving device. In this case, the internal-shutter moving device 57 is moved to the left as illustrated in FIG. 12C and contacts the contact member 55 of the internal shutter 41. Accordingly, the internal shutter 41 is rotated in the clockwise direction against the biasing force of the tension spring 51 and opens the outlet 39, allowing the toner to be discharged therefrom.

By contrast, in order to close the internal shutter 41, the internal-shutter moving device 57 in the state shown in FIG. 12C is moved to the right side, causing the tension spring 51 to pull the internal shutter 41. As a result, the internal shutter 41 rotates in the counterclockwise direction and returns to the second position as illustrated in FIG. 12B. In this state, the internal shutter 41 closes the outlet 39.

As the toner cartridge 30 is removed from the image forming apparatus main body in the state shown in FIG. 12B, the rib 56 separates from the tab 53 of the external shutter 42. Accordingly, the external shutter 42 is pulled by the tension spring 52 and hence rotated in the counterclockwise direction. At the same time, the internal shutter 41 is pulled by the tension spring 51 so that the internal shutter 41 is rotated in the same direction as the external shutter 42. As a result, the external shutter 42 and the internal shutter 41 are moved to the closed position shown in FIG. 12A at which the external shutter 42 and the internal shutter 41 close completely the outlet 39.

Figure 13:
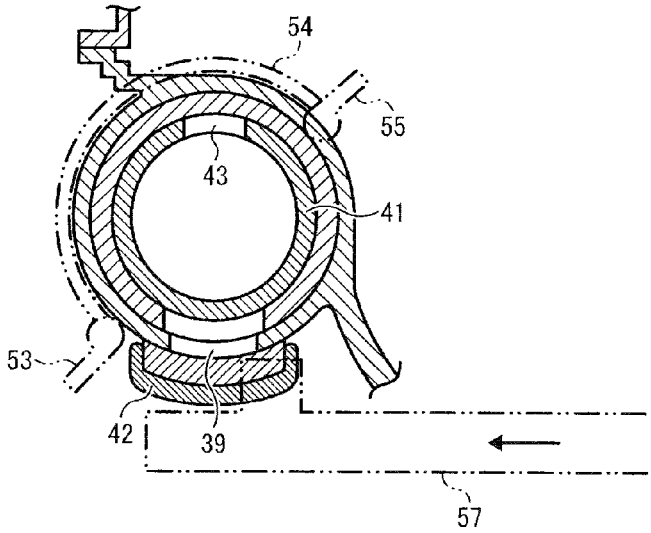
FIG. 13 is a cross-sectional diagram illustrating the internal-shutter moving device of FIG. 12C in a state in which the internal-shutter moving device is separated from the internal shutter.

According to the present illustrative embodiment, when opening the outlet 39, the internal shutter 41 does not move to the second position at which the internal shutter 41 is allowed to open the outlet 39, unless the external shutter 42 is moved to the open position as shown in FIG. 12B. In a case in which the rib 56 does not come into contact with the tab 53 due to faulty installation such as illustrated in FIG. 13, the internal shutter 41 does not move to the second position. As a result, even when the internal-shutter moving device 57 moves, the internal-shutter moving device 57 does not contact the contact member 55. According to the present illustrative embodiment, unless the external shutter 42 is moved to the open position, the internal shutter 41 remains closed, thereby preventing the internal shutter 41 from opening while the external shutter 42 is closed.

Because the internal shutter 41 is prevented from opening while the external shutter 42 is closed, accumulation of toner between the external shutter 42 and the internal shutter 41 is reduced, if not prevented entirely. With this configuration, the toner is prevented from scattering when the external shutter 42 is opened, thus preventing the toner from sticking to the internal surface of the external shutter 42. Handling of the toner cartridge 30 is made easy and contamination of hands of users or technicians is prevented. The toner cartridge 30 is replaced efficiently. Furthermore, faulty operation and degradation of the performance of the devices in the image forming apparatus caused by the scattered toner are prevented, thereby enhancing reliability of the image forming apparatus as a whole.

More specifically, according to the present illustrative embodiment, as illustrated in FIG. 12B, when the external shutter 42 is retracted completely from the position opposite the outlet 39, the internal shutter 41 comes to the second position. Accordingly, the toner is prevented from sticking to the internal surface of the external shutter 42 and is prevented from accumulating between the external shutter 42 and the internal shutter 41. It is to be noted that alternatively, the internal shutter 41 is moved to the second position when the external shutter 42 is partially retracted from the position opposite the outlet 39.

According to the present illustrative embodiment, the external shutter 42 is rotated by the rib 56. With this configuration, the external shutter 42 is rotated with a simple configuration and good operability as compared with a known configuration in which a cylindrical shutter is rotated using a rack-and-pinion gear mechanism (for example, JP2009-42567-A). For example, in a case in which the rack-and-pinion gear mechanism is employed, the teeth of the pinion need to mesh with the teeth of the rack smoothly upon installation of the toner cartridge. In order to achieve smooth engagement between the teeth of the pinion and the teeth of the rack, a guide member for guiding the toner cartridge to the image forming apparatus needs to be manufactured with accuracy.

By contrast, according to the present illustrative embodiment, the rib 56 only needs to contact the tab 53. In other words, the position of the rib 56 can be set without high accuracy. Furthermore, the configuration of the guide member for guiding the toner cartridge 30 upon installation of the toner cartridge 30 can be simple, enhancing the operability.

According to the present illustrative embodiment, the internal shutter 41 and the external shutter 42 are controlled by different operating devices, that is, the internal-shutter moving device 57 and the rib 56. With this configuration, in a case in which one of the devices fails, the other device can still operate, thereby preventing both shutters 41 and 42 from getting opened and hence preventing the toner from scattering from the outlet 39.

According to the present illustrative embodiment, the cover 47 covers the tab 53 of the external shutter 42 and the contact member 55 of the internal shutter 41 as illustrated in FIG. 9, thereby keeping users or technicians from touching the tab 53 and the contact member 55. Accordingly, the external shutter 42 and the internal shutter 41 are prevented from getting opened accidentally, hence preventing the toner from scattering from the outlet 39.

According to the present illustrative embodiment, the projection 68 of the internal shutter 41 serves as the contact member that contacts the external shutter 42 and serves also as the operating member that contacts the internal-shutter moving device 57, thereby achieving simplification of the configuration. Alternatively, the contact member and the operating member may be formed of separate parts.

According to the present illustrative embodiment, upon closing the external shutter 42 and the internal shutter 41, the external shutter 42 and the internal shutter 41 are pulled to the closed position by different springs, the tension spring 51 and the tension spring 52. Alternatively, one of the tension springs, for example, the tension spring 51 for pulling the internal shutter 41, may pull both shutters 41 and 42 to the closed position. In other words, when the internal shutter 41 is returned to the first position by the tension spring 51, the contact member 55 of the internal shutter 41 contacts the interlocking member 54 of the external shutter 42 so that the external shutter 42 is moved to the closed position in conjunction with the movement of the internal shutter 41. In this case, the tension spring 52 that pulls the external shutter 42 can be omitted, thereby reducing the number of parts.

Figure 14:
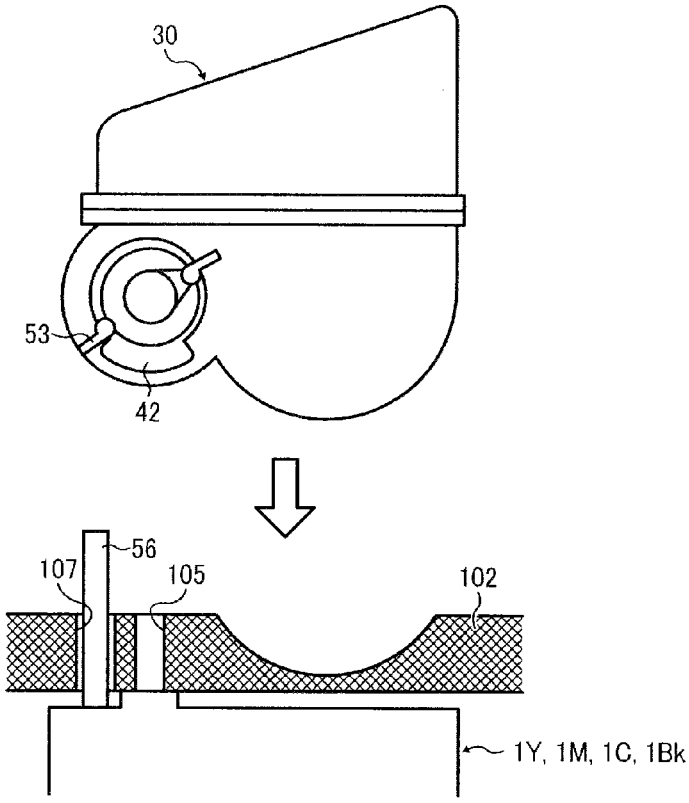
FIG. 14 is a side view schematically illustrating a process unit provided with a rib.

According to the present illustrative embodiment, the rib 56 for opening the external shutter 42 is disposed on the middle cover 102 of the image forming apparatus body. Alternatively, as illustrated in FIG. 14, the rib 56 may be disposed on the process units 1Y, 1M, 1C, and 1BK. In the configuration in which the rib 56 is disposed on the process units 1Y, 1M, 1C, and 1BK, when the middle cover 102 is closed, the rib 56 projects from a hole 107 formed in the middle cover 102 beyond the upper portion of the middle cover 102. With this configuration, because the place at which the process unit is not mounted does not have the rib 56 for opening the external shutter 42, the external shutter 42 does not open.

Figure 15:
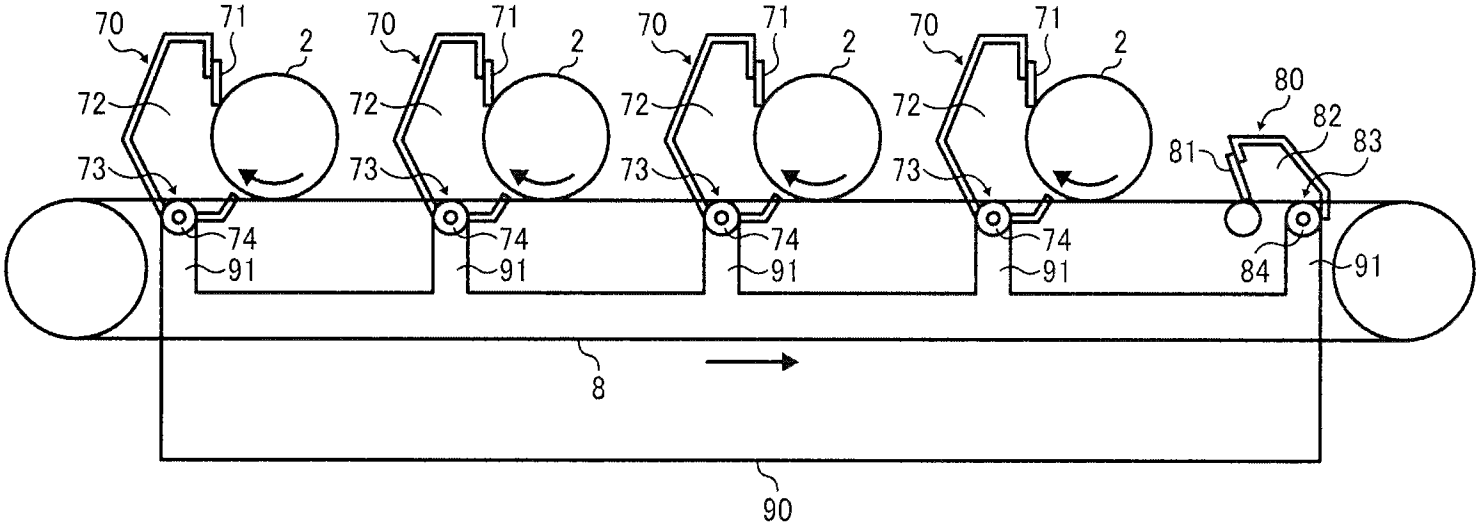
FIG. 15 is a schematic diagram illustrating a cleaning device employing the shutter assembly of an illustrative embodiment.

The shutter assembly of the above-described illustrative embodiments is not limited to the toner cartridge 30, but may be applied to a cleaning device for removing residual toner on the image bearing member. For example, as illustrated in FIG. 15, the shutter assembly of the illustrative embodiments may be applied to a cleaning device 70 for removing the residual toner remaining on the photosensitive drum 2 and a cleaning device 80 for removing the residual toner remaining on the intermediate transfer belt 8.

In this example, the cleaning device 70 includes a cleaning member 71, a collecting portion 72, an outlet 73, and a shutter assembly 74. The cleaning member 71 contacts the surface of the photosensitive drum 2 to remove the residual toner therefrom. The collecting portion 72 collects the toner removed by the cleaning member 71. The toner in the collecting portion 72 is discharged from the outlet 73. The shutter assembly 74 opens and closes the outlet 73.

The cleaning device 80 for cleaning the surface of the intermediate transfer belt 8 includes a cleaning member 81, a collecting portion 82, an outlet 83, and a shutter assembly 84. The cleaning member 81 contacts the surface of the intermediate transfer belt 8 to remove the residual toner therefrom. The collecting portion 82 collects the toner removed by the cleaning member 81. The toner in the collecting portion 82 is discharged from the outlet 83. The shutter assembly 84 opens and closes the outlet 83.

The outlet 73 of the cleaning device 70 for the photosensitive drum 2 and the outlet 83 of the cleaning device 80 for the intermediate transfer belt 8 are detachably attachable relative to an inlet 91 of a waste toner container 90. When the outlets 73 and 83 are detached from the inlet 91, or when the inlet 91 is detached from the outlets 73 and 83, the shutter assemblies 74 and 84 close the outlets 73 and 83, respectively.

In a case in which the shutter assemblies 74 and 84 in the cleaning devices 70 and 80 employ a double-shutter assembly, the shutter assemblies 74 and 84 may employ the configuration of the shutter assembly of the illustrative embodiments described above so that the internal shutter is prevented from getting opened while the external shutter is closed. Accordingly, similar to the foregoing illustrative embodiments of the present disclosure, scattering of toner and contamination of the inner surface of the external shutter with the toner such as when only the internal shutter is opened before the external shutter is opened is prevented.

According to an illustrative embodiment of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A shutter assembly for opening and closing an outlet of a powder container from which powder is discharged, comprising:

an internal shutter including a contact member, movable between a first position at which the internal shutter closes the outlet, a third position at which the internal shutter opens the outlet, and a second position between the first position and the third position, the internal shutter at the second position being movable to the third position while closing the outlet; and an external shutter movable between a closed position at which the external shutter closes the outlet and an open position at which the external shutter opens the outlet, the external shutter including an interlocking member to contact the contact member of the internal shutter to move the internal shutter, wherein as the external shutter is moved from the closed position to the open position, the internal shutter is moved from the first position to the second position in conjunction with movement of the external shutter.

2. The shutter assembly according to claim 1, wherein in a state in which the external shutter is completely retracted from a position opposite the outlet, the internal shutter is moved to the second position.

3. The shutter assembly according to claim 1, further comprising an external-shutter moving device, wherein the external shutter includes an operating member, and the external-shutter moving device contacts the operating member of the external shutter to move the external shutter from the closed position to the open position.

4. The shutter assembly according to claim 1, further comprising an internal-shutter moving device to contact the contact member of the internal shutter to move the internal shutter from the second position to the third position.

5. The shutter assembly according to claim 4, wherein the contact member of the internal shutter includes a projection that projects in a radial direction of the internal shutter and contacts the interlocking member of the external shutter and the internal-shutter moving device.

6. The shutter assembly according to claim 4, further comprising a cover to cover the contact member of the internal shutter, wherein the internal-shutter moving device moves to the cover and contacts the contact member of the internal shutter.

7. The shutter assembly according to claim 1, wherein as the internal shutter moves from the second position to the first position, the contact member of the internal shutter contacts the interlocking member of the external shutter and the external shutter moves from the open position to the closed position in conjunction with the internal shutter.

8. The shutter assembly according to claim 7, further comprising a biasing member to move the internal shutter from the third position to the first position, wherein as the contact member of the internal shutter contacts the interlocking member of the external shutter due to a force of the biasing member, the external shutter moves from the open position to the closed position.

9. The shutter assembly according to claim 1, wherein the external shutter and the internal shutter rotate concentrically with one another to open and close the outlet.

10. A powder container, comprising:

a container to store powder used for image formation;

an outlet from which the powder is discharged; and the shutter assembly according to claim 1 to open and close the outlet.

11. An image forming apparatus, comprising the powder container according to claim 10.

12. The image forming apparatus according to claim 11, wherein the powder container is detachably attachable relative to an image forming apparatus body and the shutter assembly includes an external-shutter moving device that contacts an operating member of the external shutter to move the external shutter from the closed position to the open position, wherein as the powder container is installed in the image forming apparatus body, the operating member of the external shutter contacts the external-shutter moving device.

13. The image forming apparatus according to claim 11, further comprising a process unit detachably attachable relative to an image forming apparatus body, wherein the powder container is detachably attachable relative to the image forming apparatus body and the shutter assembly includes an external-shutter moving device that is disposed on the process unit and contacts an operating member of the external shutter to move the external shutter from the closed position to the open position, wherein as the powder container is installed in the image forming apparatus body, the operating member of the external shutter contacts the external-shutter moving device disposed on the process unit mounted in the image forming apparatus body.

14. A cleaning device, comprising:

a cleaning member to remove powder for image formation on an image bearing member;

a collecting member to collect the powder removed by the cleaning member;

an outlet from which the powder collected by the collecting member is discharged; and the shutter assembly according to claim 1 to open and close the outlet.

15. An image forming apparatus, comprising:

an image bearing member to bear an image on a surface thereof; and the cleaning device according to claim 14.

* * * * *